US007806495B2

(12) United States Patent
Kasai

(10) Patent No.: US 7,806,495 B2
(45) Date of Patent: Oct. 5, 2010

(54) HEAD SUBSTRATE, PRINTHEAD, HEAD CARTRIDGE, AND PRINTING APPARATUS

(75) Inventor: Ryo Kasai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 375 days.

(21) Appl. No.: 11/949,203

(22) Filed: Dec. 3, 2007

(65) Prior Publication Data

US 2008/0129790 A1 Jun. 5, 2008

(30) Foreign Application Priority Data

Dec. 5, 2006 (JP) ..... 2006-328851

(51) Int. Cl.
*B41J 29/38* (2006.01)
*B41J 2/05* (2006.01)

(52) U.S. Cl. ..... 347/9; 347/59

(58) Field of Classification Search ..... 347/9, 347/59

See application file for complete search history.

(56) References Cited

U.S. PATENT DOCUMENTS 6,290,334 B1 9/2001 Ishinaga et al.
2004/0125157 A1* 7/2004 Edelen et al. ..... 347/9
2006/0284909 A1* 12/2006 Kasai et al. ..... 347/9

* cited by examiner

*Primary Examiner*—Julian D Huffman
(74) *Attorney, Agent, or Firm*—Fitzpatrick, Cella, Harper & Scinto

(57) ABSTRACT

This invention relates to a head substrate capable of reducing power loss and achieving a high integration degree or downsizing at low cost. The head substrate includes at least plural printing elements, plural driving elements which drive the plural printing elements, and plural level converters which boost the voltage of a driving signal for driving the plural driving elements, to a voltage enough to drive the respective driving elements. The head substrate further includes plural converted voltage generation circuits, arranged close to each other on the head substrate, for applying a common voltage for the boosting operation of level converters belonging to each group prepared by grouping the plural level converters. The plural converted voltage generation circuits share a reference voltage generation portion formed from a resistor and for generating a reference voltage for determining voltage values generated by the plural converted voltage generation circuits.

10 Claims, 11 Drawing Sheets

HEAD SUBSTRATE, PRINTHEAD, HEAD CARTRIDGE, AND PRINTING APPARATUS

BACKGROUND OF THE INVENTION

1. Field of the Invention

The present invention relates to a head substrate, printhead, head cartridge, and printing apparatus. Particularly, the present invention relates to a head substrate prepared by forming, on the same substrate, electrothermal transducers for generating heat energy necessary to print, and a driving circuit for driving the electrothermal transducers, a printhead using the head substrate, a head cartridge using the printhead, and a printing apparatus.

2. Description of the Related Art

The electrothermal transducer (heater) of a conventional inkjet printhead (to be referred to as a printhead hereinafter) and a driving circuit for the electrothermal transducer are formed on the same substrate by a semiconductor process technique as disclosed in, for example, U.S. Pat. No. 6,290,334.

Recent printheads are achieving high print speeds and high image qualities, and the number of arrayed segments is increasing. Since many segments are driven at high speed, power consumption increases, and as a result, the temperature of the printhead rises. The temperature rise of the printhead leads to an ink discharge failure and fluctuations in the amount of ink discharge, degrading the print image quality.

Of building elements of the printhead, a converted voltage generation circuit consumes large power, in addition to a heater which heats ink. At least one converted voltage generation circuit is arranged on a substrate common to a driving circuit. When a plurality of circuits are arranged on one head substrate in correspondence with a plurality of inks in order to discharge these inks for color printing, a plurality of converted voltage generation circuits are often arranged on the same substrate. As a result of increasing the number of converted voltage generation circuits, power consumption increases.

FIG. 11 is a circuit diagram showing an example of a conventional converted voltage generation circuit and its peripheral circuit.

Part of FIG. 11 except for a converted voltage generation circuit 300 shows an equivalent circuit for one segment. A converted voltage VHTM output from the converted voltage generation circuit 300 is commonly used by level converters 307 in a plurality of segments. The level converter 307 boosts, to a signal of the converted voltage VHTM, a signal of a logic power supply voltage (e.g., 3.3 V) for operating a logic circuit such as a shift register. The output voltage from the level converter 307 is applied to the gate of a MOSFET serving as a switching element (driving element) 305. The switching element 305 is series-connected to a heater 304. The converted voltage generation circuit 300 uses, as a power supply, the same voltage VHT as a heater voltage VH of about 24 V applied to a heater. The converted voltage generation circuit 300 is formed from a resistance element including a diffusion resistance or polysilicon element, and a MOSFET 306.

The converted voltage generation circuit takes the form of a source follower circuit. By applying a predetermined reference voltage to the gate of the MOSFET 306, the value of the converted voltage VHTM is determined. Since a constant voltage is always applied to the gate of the MOSFET 306, this circuit arrangement can suppress variations of a converted potential even if a current abruptly flows through the drain-source path of the MOSFET 306. To always keep the converted potential constant, a constant voltage must always be applied to the gate of the MOSFET 306.

As an example of a reference voltage generation portion 303, a dividing resistance contributes to generating a predetermined reference voltage in FIG. 11. The resistance element is desirably an element (e.g., polysilicon element) whose resistance value hardly varies by heat.

However, this circuit arrangement consumes a large amount of power because a through current always flows through the reference voltage generation portion.

In addition, the resistance element used as the dividing resistance poses a problem. A resistance element used for a semiconductor is generally a diffusion resistance whose layout area is small. However, the diffusion resistance changes depending on the bias voltage and is not an ideal element used as the dividing resistance. For this reason, the above-described conventional art adopts a metal resistor or polysilicon resistor independent of the bias voltage. However, a resistor of this type requires a large layout area on the head substrate, increasing the chip size and raising the manufacturing cost of the head substrate.

SUMMARY OF THE INVENTION

Accordingly, the present invention is conceived as a response to the above-described disadvantages of the conventional art.

For example, a head substrate according to this invention is capable of reducing power loss and achieving a high integration degree or downsizing at low cost.

According to one aspect of the present invention, preferably, there is provided a head substrate comprising: a plurality of printing elements; a plurality of driving elements which drive the plurality of printing elements; a plurality of level converters which boost a voltage of a driving signal for driving the plurality of driving elements; and a plurality of converted voltage generation circuits which are arranged in correspondence with groups of the plurality of level converters, and apply a common voltage to level converters belonging to each group, wherein the plurality of converted voltage generation circuits share a reference voltage generation portion which is formed from a resistor and generates a reference voltage for determining voltage values generated by the plurality of converted voltage generation circuits.

According to another aspect of the present invention, preferably, there is provided a printhead using a head substrate described above.

According to still another aspect of the present invention, preferably, there is provided a head cartridge integrating the above printhead and an ink tank containing ink to be supplied to the printhead.

According to still another aspect of the present invention, preferably, there is provided a printing apparatus using the above printhead.

The invention is particularly advantageous since a plurality of converted voltage generation circuits share a single reference voltage generation portion, and the number of reference voltage generation portions consuming large amounts of power can be decreased, thus reducing power consumption. The reduction in power consumption contributes to suppressing the temperature rise of the printhead and suppressing degradation of the image quality caused by the temperature rise.

A resistor which forms the reference voltage generation portion conventionally occupies a large layout area on the head substrate. The decrease in the number of reference voltage generation portions contributes to reducing the head substrate area. As a result, the head substrate can be downsized, thus reducing the production cost.

Further features of the present invention will become apparent from the following description of exemplary embodiments (with reference to the attached drawings).

DESCRIPTION OF THE EMBODIMENTS

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "printing element" generally means a set of a discharge orifice, a liquid channel connected to the orifice and an element to generate energy utilized for ink discharge.

The term "printhead substrate (head substrate)" in the description not only includes a simple substrate made of a silicon semiconductor, but also broadly includes a substrate with elements, wiring lines, and the like.

The expression "on a substrate" not only includes "on an element substrate", but also broadly includes "on the surface of an element substrate" and "inside of an element substrate near its surface". The term "built-in" in the present invention not only includes "simply arrange separate elements on a substrate surface", but also broadly includes "integrally form and manufacture elements on an element substrate by a semiconductor circuit manufacturing process or the like".

A typical overall arrangement and control arrangement of a printing apparatus using a printhead according to the present invention will be described.

<Description of Inkjet Printing Apparatus (FIG. 1)>

Figure 1:
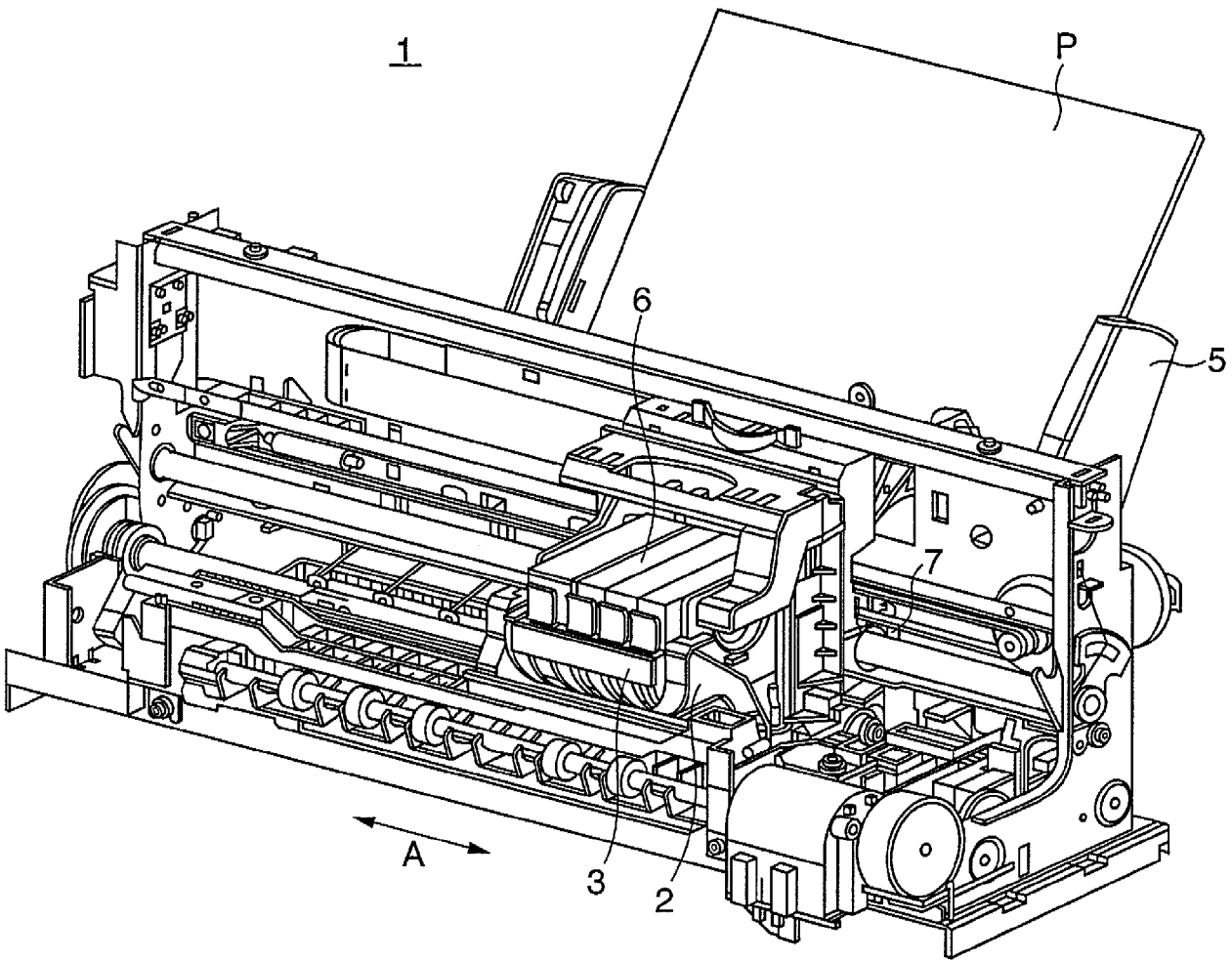
FIG. 1 is a schematic perspective view showing the outer appearance of the structure of an inkjet printing apparatus as a typical embodiment of the present invention.

FIG. 1 is a schematic perspective view showing the outer appearance of the structure of an inkjet printing apparatus 1 as a typical embodiment of the present invention.

In the inkjet printing apparatus (to be referred to as a printing apparatus hereinafter), as shown in FIG. 1, a carriage 2 supports a printhead 3 for printing by discharging ink according to the inkjet method. The carriage 2 can reciprocate in directions indicated by an arrow A, thereby printing. A print medium P such as print paper is fed via a paper feed mechanism 5 and conveyed to a print position. At the print position, the printhead 3 prints by discharging ink to the print medium P.

The carriage 2 of the printing apparatus 1 supports not only the printhead 3, but also an ink cartridge 6 which contains ink to be supplied to the printhead 3. The ink cartridge 6 is detachable from the carriage 2.

The printing apparatus 1 shown in FIG. 1 can print in color. For this purpose, the carriage 2 supports four ink cartridges which respectively contain magenta (M), cyan (C), yellow (Y), and black (K) inks. The four ink cartridges are independently detachable.

The printhead 3 according to the embodiment employs an inkjet method of discharging ink by using heat energy. For this purpose, the printhead 3 comprises, as a printing element, an electrothermal transducer for generating heat energy. The electrothermal transducer is arranged in correspondence with each orifice. By applying a pulse voltage to an electrothermal transducer corresponding to a print signal, ink is discharged from a corresponding orifice.

<Control Arrangement of Inkjet Printing Apparatus (FIG. 2)>

Figure 2:
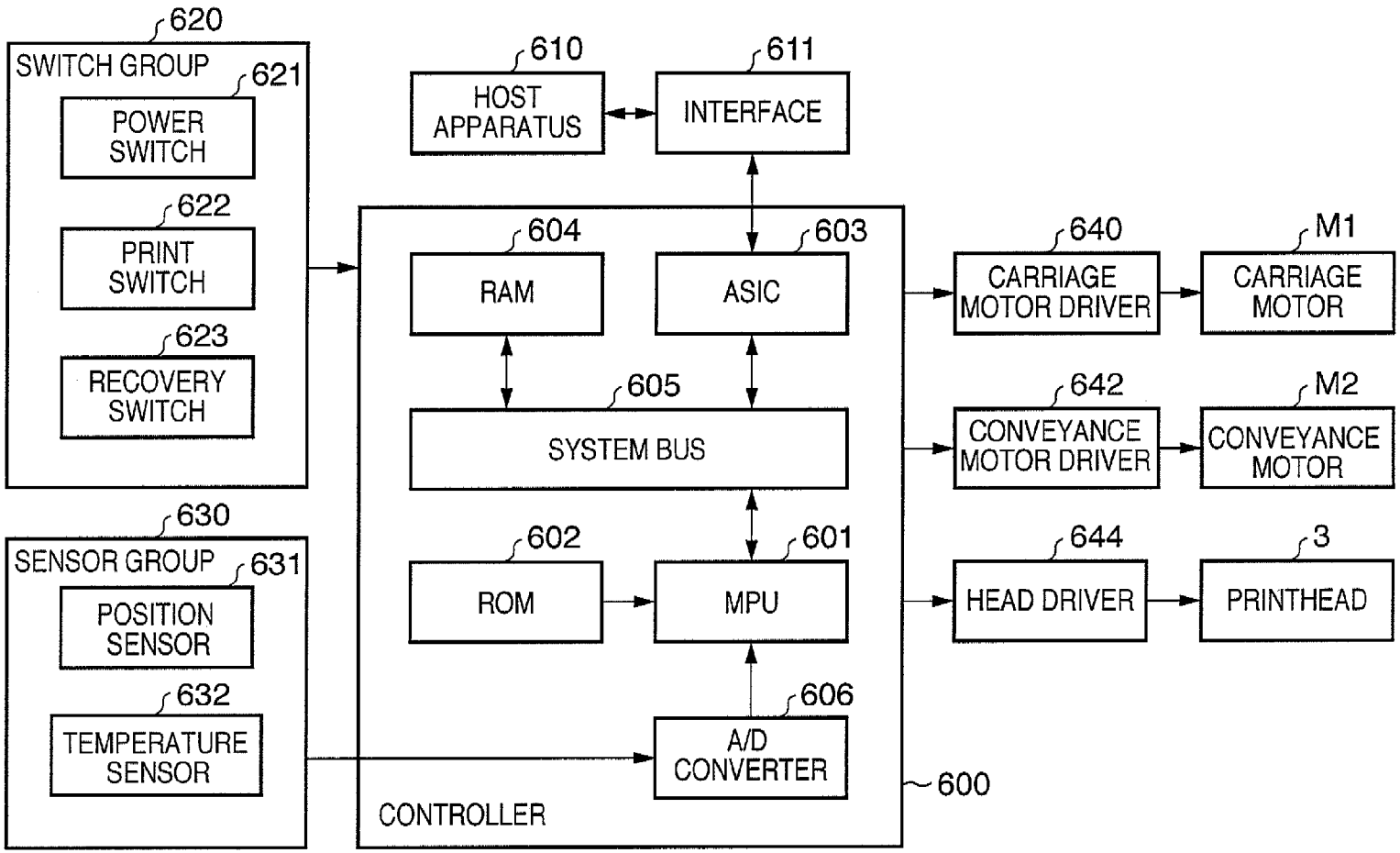
FIG. 2 is a block diagram showing the arrangement of the control circuit of the printing apparatus.

FIG. 2 is a block diagram showing the control arrangement of the printing apparatus shown in FIG. 1.

As shown in FIG. 2, a controller 600 comprises a MPU 601, ROM 602, ASIC (Application Specific Integrated Circuit) 603, RAM 604, system bus 605, and A/D converter 606. The ROM 602 stores a program corresponding to a control sequence, a predetermined table, and other permanent data. The ASIC 603 generates control signals for controlling a carriage motor M1, a conveyance motor M2, and the printhead 3. The RAM 604 is used as an image data expansion area, a work area for executing a program, and the like. The system bus 605 connects the MPU 601, ASIC 603, and RAM 604 to each other, and allows exchanging data. The A/D converter 606 receives analog signals from a sensor group (to be described below), A/D-converts the analog signals, and supplies digital signals to the MPU 601.

In FIG. 2, a computer (or an image reader, digital camera, or the like) 610 serves as an image data source and is generally called a host apparatus. The host apparatus 610 and printing apparatus 1 transmit/receive image data, commands, status signals, and the like via an interface (I/F) 611. Image data is input as, for example, raster data.

A switch group 620 includes a power switch 621, print switch 622, and recovery switch 623.

A sensor group 630 detects an apparatus status, and includes a position sensor 631 and temperature sensor 632.

A carriage motor driver 640 can drive the carriage motor M1 for reciprocating the carriage 2 in the directions indicated by the arrow A. A conveyance motor driver 642 drives the conveyance motor M2 for conveying the print medium P. A head driver 644 drives the printhead 3.

The ASIC 603 transfers print data DATA of a printing element (heater) to the printhead while directly accessing the storage area of the RAM 604 in printing and scanning by the printhead 3. In addition, the printhead 3 receives control signals from the MPU 601 and ASIC 603 via the head driver 644. The printhead 3 also receives power from a power supply (not shown).

Figure 3B:
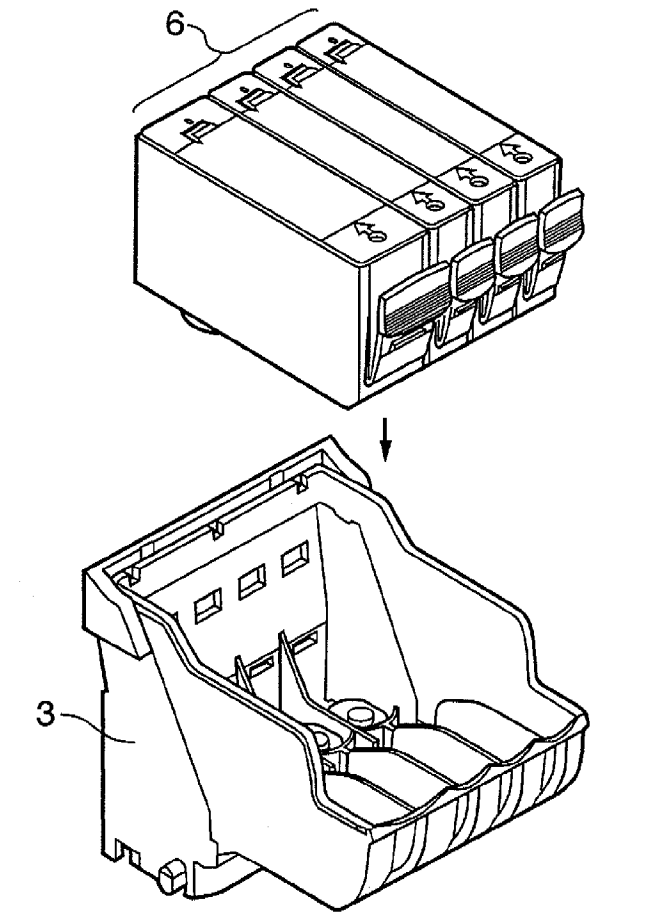
FIGS. 3A and 3B are perspective views showing the outer appearance of a printhead cartridge 1000 made up of a printhead and ink tank.
Figure 3A:
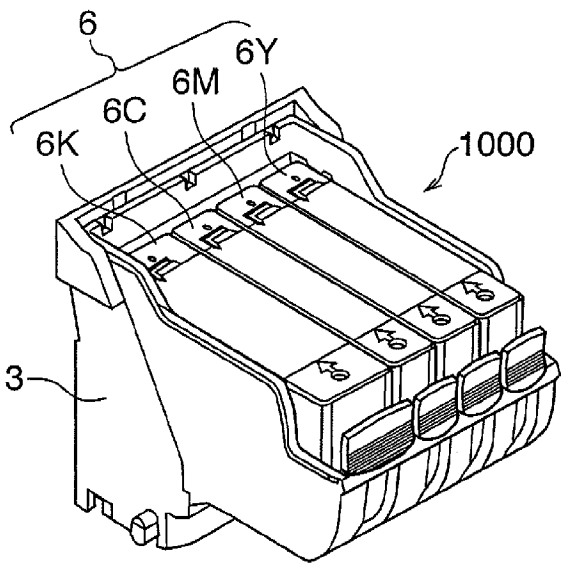

FIGS. 3A and 3B are perspective views showing the outer appearance of a printhead cartridge 1000 made up of the printhead and ink tank.

As is apparent from FIGS. 3A and 3B, the printhead cartridge 1000 comprises the ink cartridge 6 having four ink tanks, and the printhead 3, which are detachable from each other. FIG. 3A shows a state in which the four ink tanks of the ink cartridge 6 are mounted on the printhead 3. FIG. 3B shows a state in which the four ink tanks of the ink cartridge 6 are replaceably detached from the printhead 3.

The ink cartridge 6 has four ink tanks 6Y, 6C, 6M, and 6K which contain yellow (Y) ink, cyan (C) ink, magenta (M) ink, and black (K) ink, respectively. When running out of ink, each ink tank can be individually detached from the printhead and replaced.

The printhead cartridge 1000 is fixed and supported by the positioning means and electrical contact of the carriage 2 attached to the printing apparatus main body. The printhead cartridge 1000 is detachable from the carriage 2.

The printhead 3 employs a method of printing using a heater which generates heat energy in order to generate film boiling in ink in accordance with an electrical signal. The printhead 3 is a so-called side shooter printhead which discharges ink to a side facing the heater surface.

Figure 4:
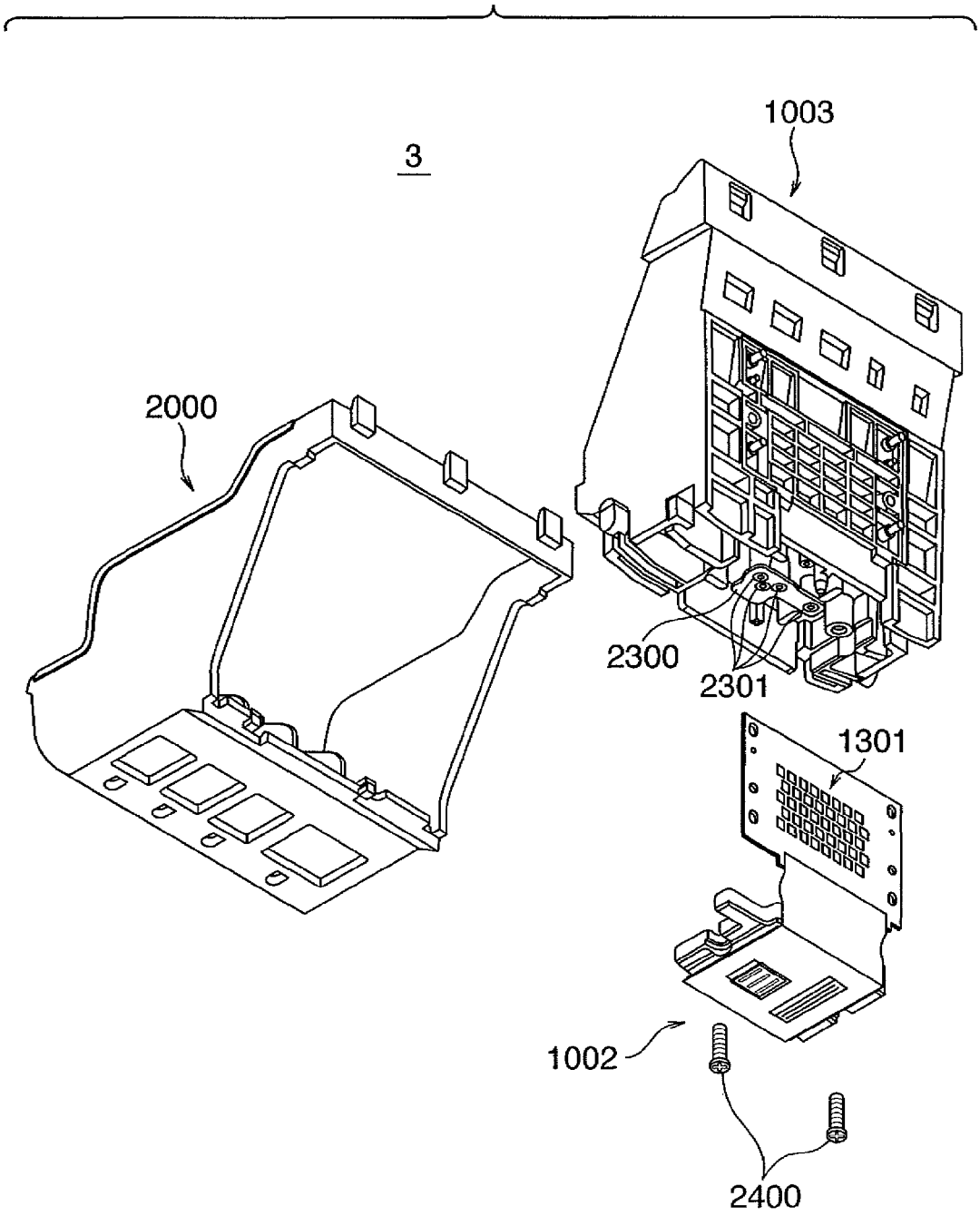
FIG. 4 is an exploded perspective view showing the detailed structure of a printhead 3.

FIG. 4 is an exploded perspective view showing the detailed structure of the printhead 3.

As shown in FIG. 4, the printhead 3 comprises a printing element unit 1002, an ink supply unit 1003, and a tank holder 2000 which holds four ink tanks. The printing element unit 1002 has a head substrate 1100C (to be described later) and head substrate 1100K (to be described later) each having a plurality of heating resistors (heaters). The printing element unit 1002 and ink supply unit 1003 are fixed in press contact with each other by screws 2400 via a joint sealing member 2300 so that the ink communication ports (not shown) of the printing element unit 1002 and ink communication ports 2301 of the ink supply unit 1003 communicate with each other without leaking ink.

The ink cartridge 6 and printhead 3 may be separable from each other, as described above, but may also be integrated into an exchangeable ink cartridge IJC.

Figure 5:
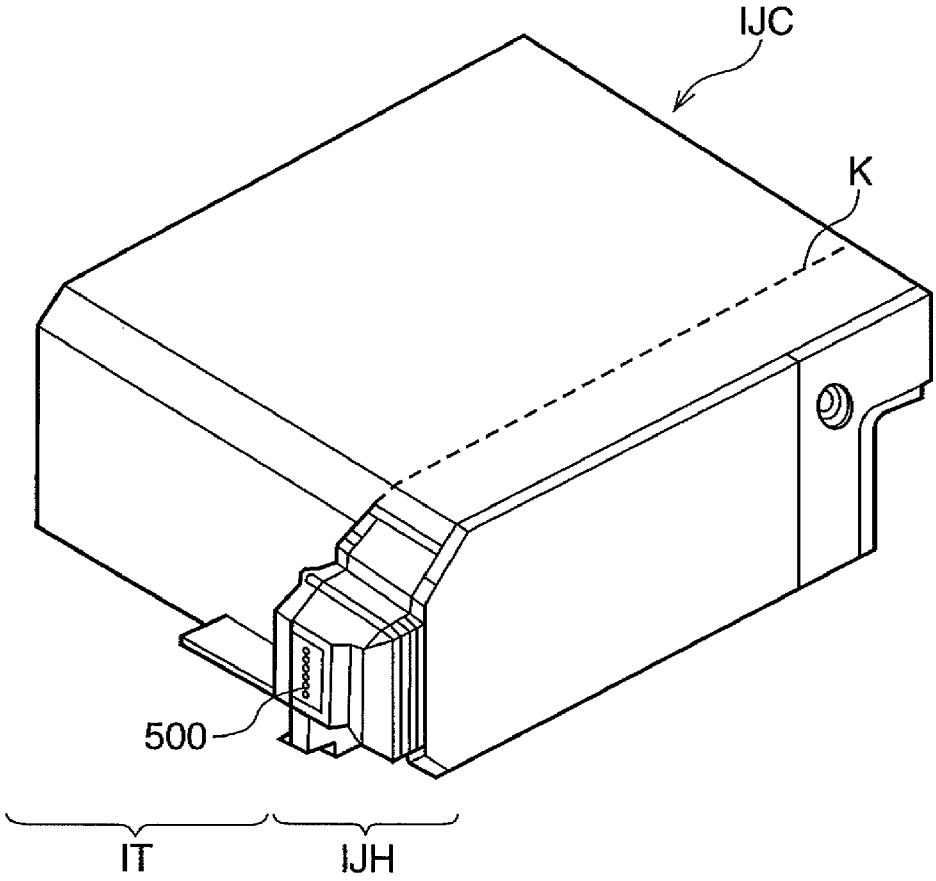
FIG. 5 is a perspective view showing the outer appearance of the structure of a head cartridge IJC which integrates the ink tank and printhead.

FIG. 5 is a perspective view showing the outer appearance of the structure of the head cartridge IJC which integrates the ink tank and printhead. In FIG. 5, a dotted line K indicates the boundary between an ink tank IT and a printhead IJH. The head cartridge IJC has an electrode (not shown) to receive an electrical signal supplied from the carriage 2 when the head cartridge IJC is mounted on the carriage 2. The electrical signal drives the printhead IJH to discharge ink, as described above.

In FIG. 5, reference numeral 500 denotes an ink orifice array.

Embodiments of the head substrate of the printhead mounted in the printing apparatus having the above-described arrangement will be described.

In FIG. 4, the head substrate means both a head substrate having three ink supply ports used to discharge color inks, and a head substrate having one ink supply port used to discharge a black ink. In the following description, the head substrate having one ink supply port will be called the head substrate 1100K, and the head substrate having three ink supply ports will be called the head substrate 1100C.

First Embodiment

Figure 6:
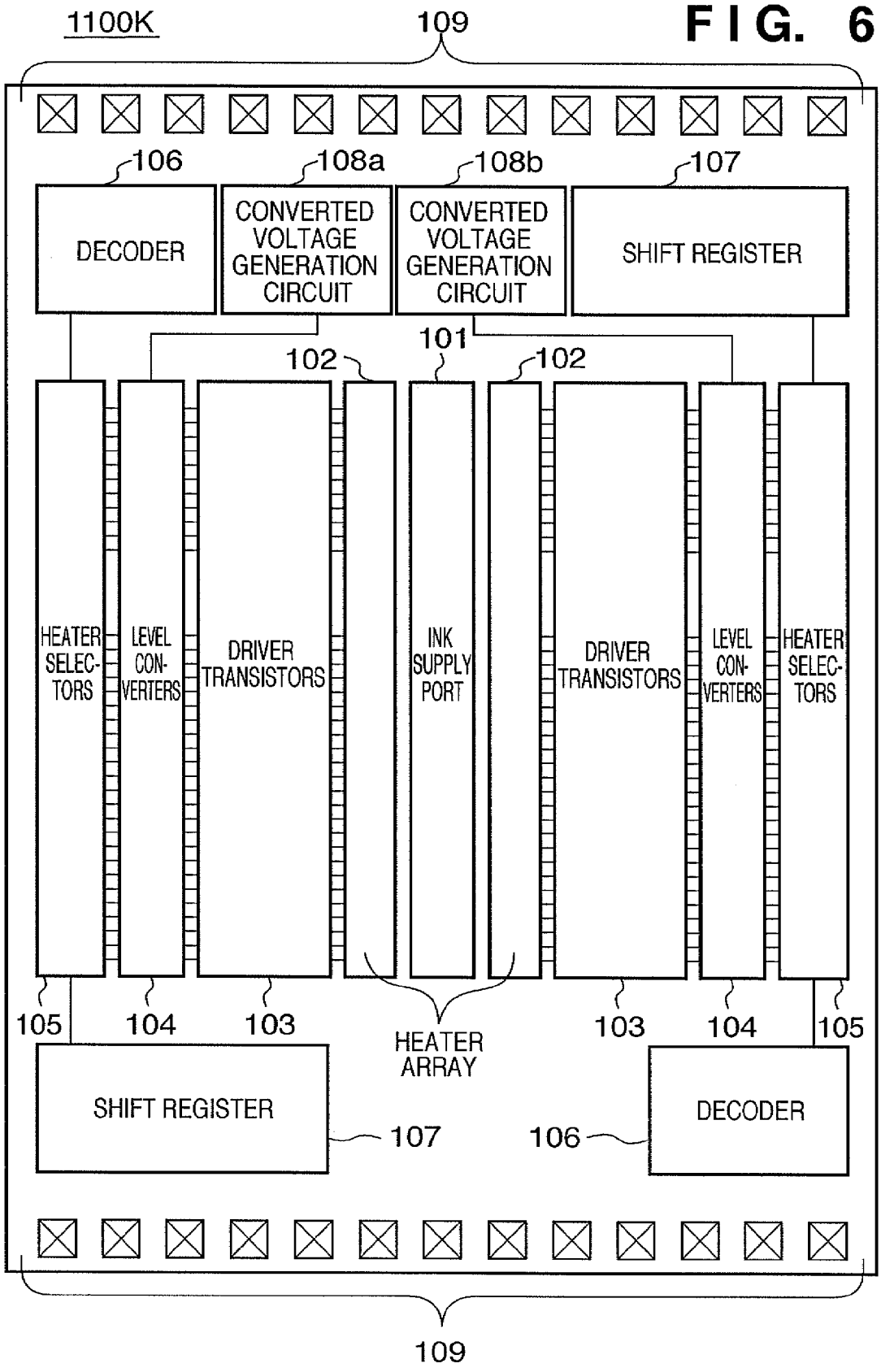
FIG. 6 is a plan view showing the layout structure of a head substrate 1100K.

FIG. 6 is a plan view showing the layout structure of a head substrate 1100K which integrates heaters and driving circuits by building them in the same substrate.

On the head substrate 1100K, as shown in FIG. 6, heater arrays 102 each having a plurality of heaters for discharging ink are arranged on the two sides of an ink supply port 101 on one surface of an Si substrate 0.5 to 1 mm thick. A plurality of ink channels (not shown) and a plurality of ink orifices (not shown) are formed by photolithography in correspondence with the plurality of heaters.

Further on the head substrate 1100K, driver transistors (corresponding to the above-mentioned driving elements) 103 necessary to drive the heaters of the heater arrays 102, level converters 104, and heater selectors 105 such as AND circuits are arranged along the heater arrays 102. Shift registers 107, decoders 106, and pads 109 are arranged at the upper and lower ends of the head substrate 1100K. The "upper and lower ends" mean "upper and lower ends" on the sheet surface of FIG. 6. As is apparent from FIG. 6, two converted voltage generation circuits 108*a* and 108*b* arranged near the upper end of the head substrate 1100K (upper end on the sheet surface of FIG. 6) supply powers to the level converters 104 corresponding to the two heater arrays 102 which face each other via the ink supply port 101.

The head substrate 1100K shown in FIG. 6 has a plurality of electrode pads which are denoted by reference numeral 109.

Print data and control signals are input to the shift register 107 and decoder 106 via the pad 109. Signals output from the shift register 107 and decoder 106 are input to the heater selectors 105 formed from AND circuits, each of which performs logical-product of a signal from the decoder 106 and a signal from the shift register or a latch (not shown) arranged in correspondence with the shift register. A heater selection signal (driving signal) from each of the heater selectors 105 selects a heater to which a driving current is to be finally supplied.

To drive the driver transistors 103 by the heater selection signals output from the heater selectors 105, the level converters 104 boost the voltage level of the heater selection signals. The boosted signal voltage is high enough to drive the driver transistors 103. The boosted signal voltage is higher than a control voltage for driving the shift register or the like, and the logic voltage of a print data signal, and is lower than the tolerable voltage of a driver transistor and that of the building element of the level converter. This voltage is generated by the converted voltage generation circuits 108*a* and 108*b*.

The boosted heater selection signal drives each of the driver transistors (driving elements) 103, and a current flows through a desired heater of the heater array 102. Ink is boiled by heat generated by the heater and discharged by the pressure of boiling.

Figure 7:
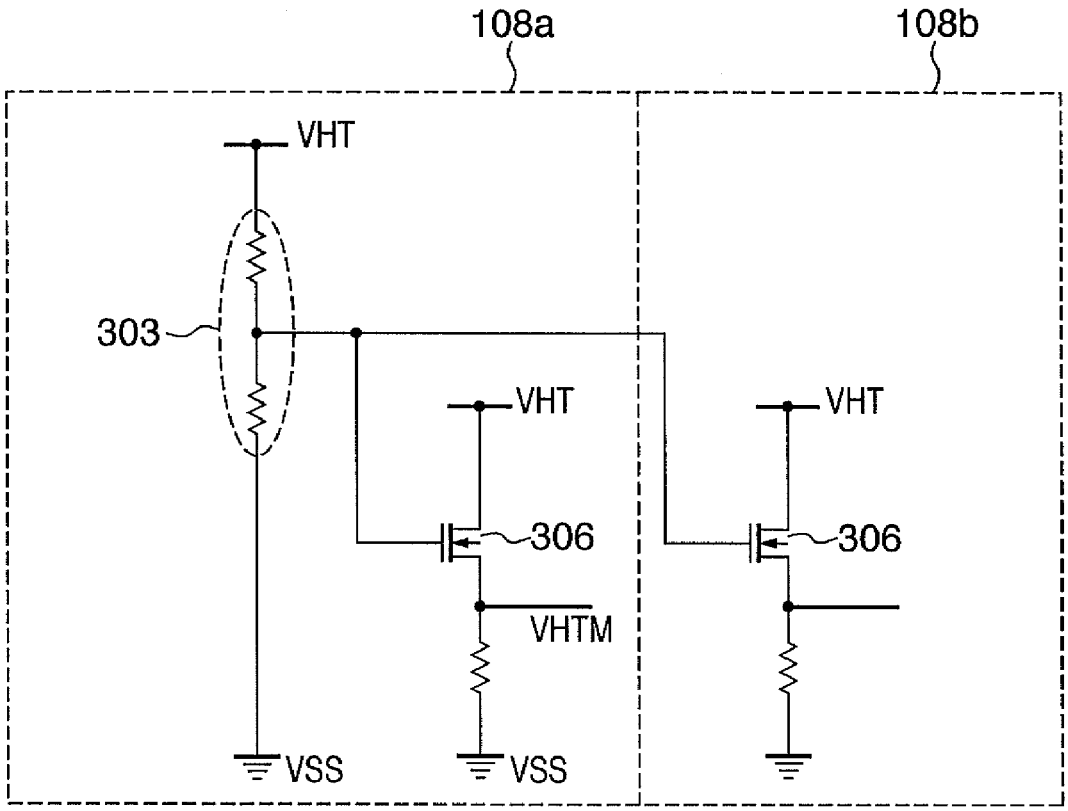
FIG. 7 is a circuit diagram showing the equivalent circuit of a converted voltage generation circuit implemented on the head substrate 1100K shown in FIG. 6.

FIG. 7 is a circuit diagram showing the equivalent circuits of the converted voltage generation circuits 108*a* and 108*b* formed on the head substrate 1100K. In FIG. 7, the same reference numerals and symbols as those in FIG. 11 denote the same building elements and voltages already described with reference to FIG. 11, and a description thereof will not be repeated.

Figure 11:
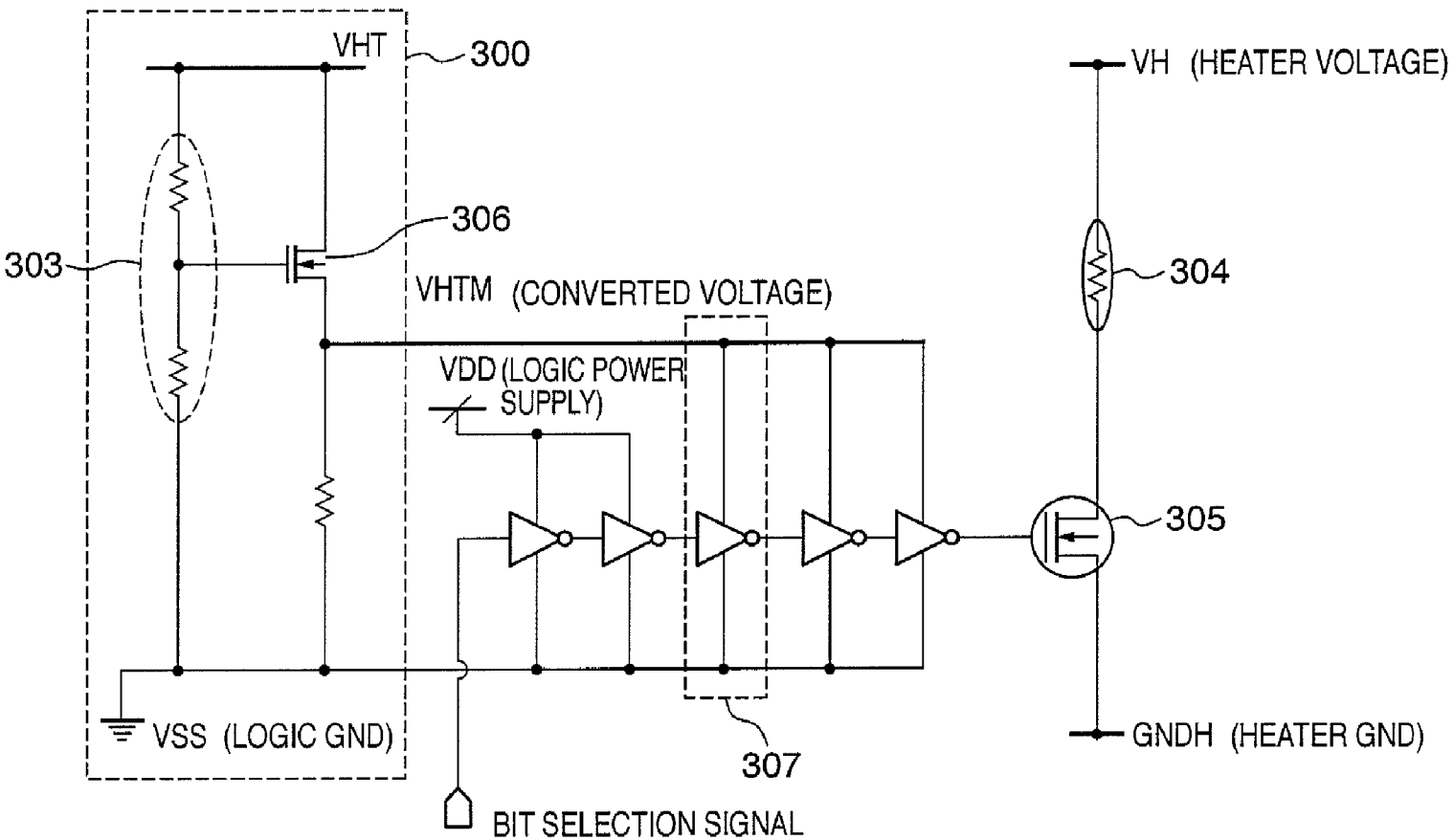
FIG. 11 PRIOR ART
FIG. 11 is a circuit diagram showing an example of the converted voltage generation circuit of a conventional printhead and its peripheral circuit.

In the circuit arrangement shown in FIG. 7, the two converted voltage generation circuits 108*a* and 108*b* share a reference voltage generation portion 303, which is conventionally arranged for each converted voltage generation circuit, as shown in FIG. 11. This arrangement of the embodiment can omit one reference voltage generation portion 303 through which a through current flows to consume large power, and can reduce power consumption. For the same through current value as the conventional one (the dividing resistance value does not change), power consumption becomes half of the conventional one. The temperature rise of the printhead, which degrades the print image quality, can also be suppressed by reducing power consumption.

As the element of the reference voltage generation portion 303, the first embodiment adopts a polysilicon resistor whose resistance value hardly varies upon a temperature change but whose layout area is large. Even in this case, by sharing the reference voltage generation portion 303, the number of necessary resistance elements can be halved to halve the layout area. This allows increasing the number of heaters per head substrate, or integrating another circuit. Since the head substrate area can also be reduced, the chip cost can be suppressed.

The element of the reference voltage generation portion 303 may be a resistor other than the polysilicon resistor. However, the polysilicon resistor is desirably used because it does not depend on the bias voltage, as described above.

Figure 8:
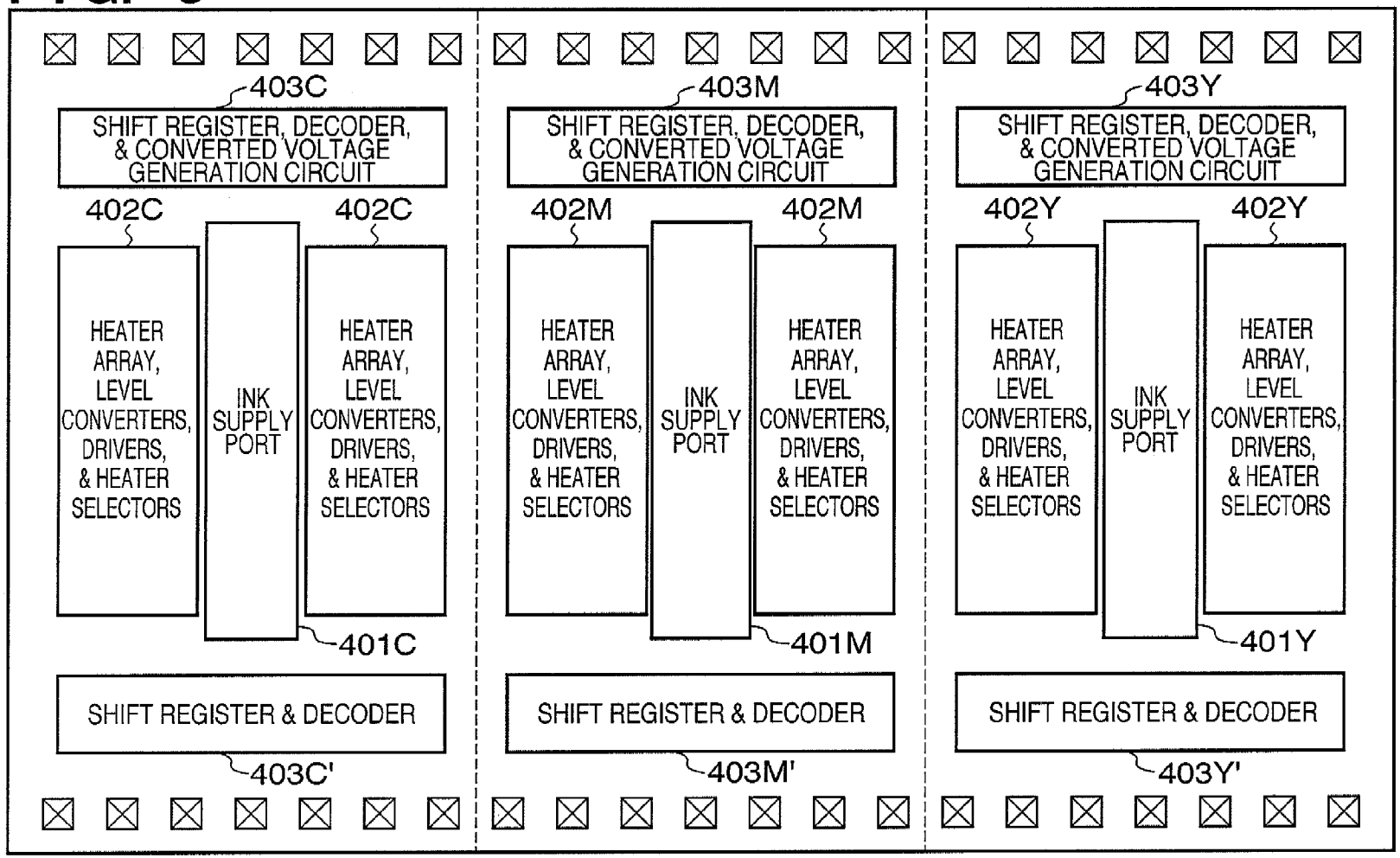
FIG. 8 is a plan view showing the layout structure of a head substrate 1100C.

FIG. 8 is a plan view showing the layout structure of a head substrate 1100C which integrates heaters and driving circuits on the same substrate.

One head substrate 1100C comprises three ink supply ports 401C, 401M, and 401Y. Circuit groups 402C, 402M, and 402Y including heater arrays, driver transistors, level converters, and heater selectors are formed on two sides along the respective ink supply ports. Circuit groups 403C, 403M, and 403Y including shift registers, decoders, and converted voltage generation circuits are formed at one end of a corresponding one of the ink supply ports along the long side direction. Further, circuit groups 403C', 403M', and 403Y' including shift registers and decoders are formed at the other end of a corresponding one of the ink supply ports along the long side direction.

Two converted voltage generation circuits are implemented in each of the circuit groups 403C, 403M, and 403Y in order to apply converted voltages to level converters arranged on the two sides of each of the ink supply ports 401C, 401M, and 401Y. That is, level converters for each ink supply port are grouped into one group, and one converted voltage generation circuit is implemented for each group.

When a plurality of (six in this case) converted voltage generation circuits are arranged on one head substrate, as described above, they share a single reference voltage generation portion in the first embodiment.

Note that level converters on one side of each ink supply port are grouped, but those on the two sides may also be grouped. In the present invention, a plurality of converted voltage generation circuits share a single reference voltage generation portion regardless of the grouping unit.

Figure 9:
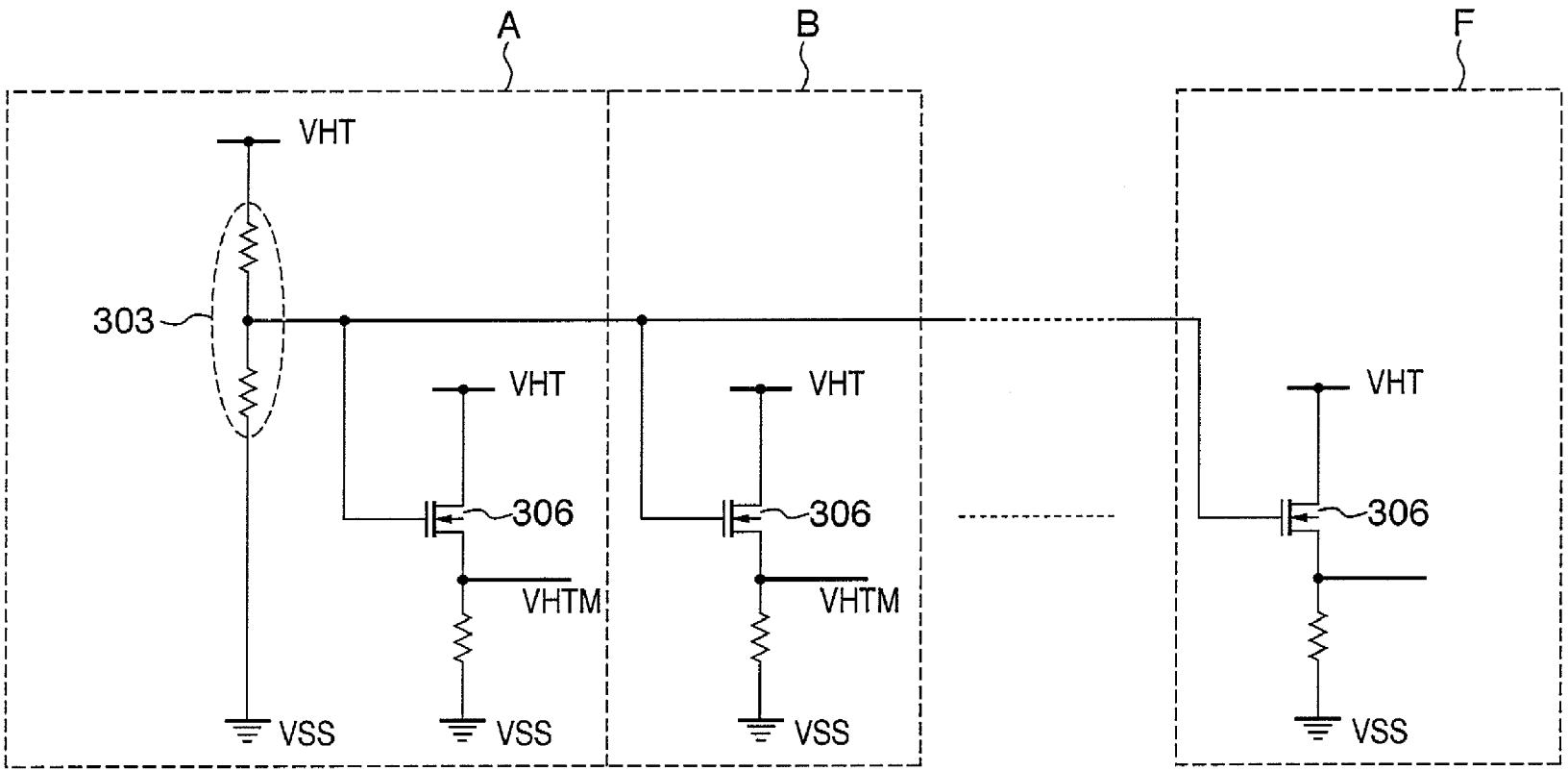
FIG. 9 is a circuit diagram showing the equivalent circuit of a converted voltage generation circuit implemented on the head substrate 1100C shown in FIG. 8.

FIG. 9 is a circuit diagram showing the equivalent circuits of six converted voltage generation circuits formed on the head substrate 1100C. In FIG. 9, the same reference numerals and symbols as those in FIG. 11 denote the same building elements and voltages already described with reference to FIG. 11, and a description thereof will not be repeated.

As shown in FIG. 9, according to the first embodiment, six converted voltage generation circuits A to F share one reference voltage generation portion 303. When the six converted voltage generation circuits share one reference voltage generation portion, the effect of reducing the layout area of the polysilicon resistor at the reference voltage generation portion and the effect of reducing power consumption are three times as large as the effects obtained by the head substrate 1100K.

According to the above-described embodiment, a plurality of converted voltage generation circuits can share one reference voltage generation portion. A large layout area necessary for the reference voltage generation portion can be reduced. Power consumed by the reference voltage generation portion can also be reduced. This can also suppress the temperature rise of the head substrate.

Second Embodiment

As described above in the first embodiment, if a current simultaneously flows through a plurality of converted voltage generation circuits while the converted voltage generation circuits share one reference voltage generation portion, the converted voltage value of the reference voltage generation portion may greatly fluctuate in comparison with the conventional art. If the converted voltage fluctuates much more, this may cause a circuit malfunction or an abnormal waveform of a current supplied to the heater.

The second embodiment will describe a converted voltage generation circuit capable of suppressing fluctuations of the reference voltage.

Figure 10:
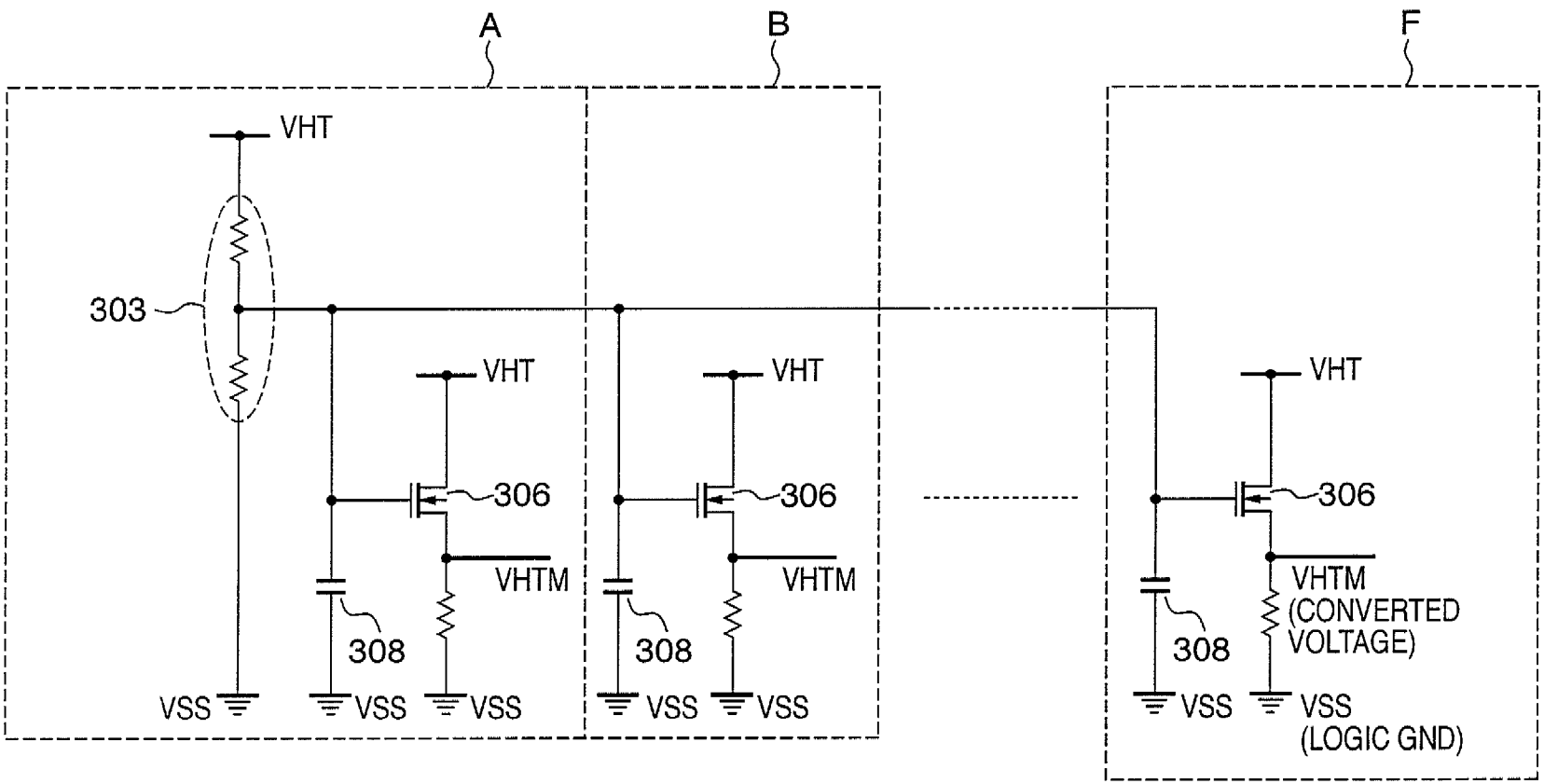
FIG. 10 is an equivalent circuit diagram showing the arrangement of a converted voltage generation circuit capable of suppressing fluctuations of the reference voltage.

FIG. 10 is an equivalent circuit diagram showing the arrangement of a converted voltage generation circuit according to the second embodiment.

In FIG. 10, an arrangement which suppresses fluctuations of the reference voltage is added to the arrangement shown in FIG. 9 in which six converted voltage generation circuits share one reference voltage generation portion. In the arrangement of FIG. 10, a capacitor 308 is arranged immediately before the gate of each MOSFET 306.

By employing this arrangement, the capacitor 308 can suppress abrupt fluctuations of the reference voltage, preventing a circuit malfunction and an abnormal waveform of the heater current.

As another measure to prevent fluctuations of the converted voltage, a through current flowing through the dividing resistor of a reference voltage generation portion 303 can also be increased. In this case, the resistance values of two dividing resistors are decreased while maintaining the ratio of the two dividing resistances. As a result, fluctuations of the converted voltage can be suppressed, and the layout area of a polysilicon resistor can be reduced by decreasing the value of the dividing resistor.

For example, when six converted voltage generation circuits share a reference voltage generation portion, the layout area of the resistance element can be reduced to ⅙, as also described in the first embodiment. Assume that the through current is multiplied by n (equivalent to a current value for one conventional MOSFET gate) in order to prevent fluctuations of the converted voltage. In this case, the layout area of the polysilicon resistor can be reduced to $1/n^2$ (for n=10, 1/100), compared with the conventional art.

By sharing the reference voltage generation portion and increasing the through current value, the layout area of the converted voltage generation circuit can be greatly reduced, and at the same time, fluctuations of the converted voltage can be suppressed.

In the above-described embodiments, droplets discharged from the printhead are ink, and the liquid contained in the ink tank is ink. However, the content is not limited to ink. For example, the ink tank may also contain a process liquid which is discharged to a print medium in order to improve the fixing characteristic and water repellency of a printed image and improve the print quality.

In the above-described embodiments, high print density and high resolution can be achieved by, of inkjet printing methods, a method of changing the ink state by heat energy generated by a means (e.g., electrothermal transducer) for generating heat energy to discharge ink.

In addition, the inkjet printing apparatus according to the present invention may also take the form of an image output apparatus for an information processing apparatus such as a computer, the form of a copying apparatus combined with a reader or the like, and the form of a facsimile apparatus having transmission and reception functions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-328851, filed Dec. 5, 2006, which is hereby incorporated by reference herein in its entirety.

What is claimed is:

1. A head substrate comprising:

a plurality of printing elements;

a plurality of driving elements which drive said plurality of printing elements;

a plurality of level converters which boost a voltage of a driving signal for driving said plurality of driving elements; and a plurality of converted voltage generation circuits which are arranged in correspondence with groups of said plurality of level converters, and apply a common voltage to level converters belonging to each group, wherein said plurality of converted voltage generation circuits share a reference voltage generation portion which is in the head substrate and which is formed from a resistor and generates a reference voltage for determining voltage values generated by said plurality of converted voltage generation circuits.

2. The head substrate according to claim 1, wherein each of said plurality of converted voltage generation circuits includes:

a MOSFET; and a resistor series-connected to a source of said MOSFET, and the same voltage as a voltage applied to said plurality of printing elements is applied to a drain of said MOSFET.

3. The head substrate according to claim 2, wherein one of said plurality of converted voltage generation circuits includes the reference voltage generation portion, the resistor which forms the reference voltage generation portion includes two series-connected resistor elements, the same voltage as a voltage applied to said plurality of printing elements is applied to one end of the two series-connected resistor elements, and a voltage divided by the two series-connected resistor elements is applied as the reference voltage to a gate of said MOSFET included in each of said plurality of converted voltage generation circuits.

4. The head substrate according to claim 3, wherein the gate of said MOSFET is connected to a capacitor.

5. The head substrate according to claim 3, wherein the resistor which forms the reference voltage generation portion includes a polysilicon resistor.

6. The head substrate according to claim 1, wherein each of said plurality of printing elements includes an electrothermal transducer which generates heat energy used to discharge ink.

7. The head substrate according to claim 6, further comprising a rectangular ink supply port which is elongated in one direction and receives ink from outside, wherein said plurality of printing elements are arrayed along a long side direction of the ink supply port.

8. A printhead using a head substrate according to claim 1.

9. A head cartridge integrating a printhead according to claim 8 and an ink tank containing ink to be supplied to the printhead.

10. A printing apparatus using a printhead according to claim 8.

* * * * *